US006863224B2

(12) United States Patent
Terada et al.

(10) Patent No.: US 6,863,224 B2
(45) Date of Patent: Mar. 8, 2005

(54) LIQUID SPRAY DEVICE

(75) Inventors: Takao Terada, Kyoto (JP); Kei Asai, Kyoto (JP); Masato Arai, Kyoto (JP); Shinichi Itoh, Kyoto (JP); Shinya Tanaka, Kyoto (JP); Masashi Osuga, Kyoto (JP); Toshiji Takahashi, Toyohashi (JP)

(73) Assignee: Omron Corporation, Kyoto (JP)

( * ) Notice: Subject to any disclaimer, the term of this patent is extended or adjusted under 35 U.S.C. 154(b) by 167 days.

(21) Appl. No.: 10/381,986

(22) PCT Filed: Oct. 1, 2001

(86) PCT No.: PCT/JP01/08663

§ 371 (c)(1),
(2), (4) Date: Apr. 1, 2003

(87) PCT Pub. No.: WO02/28545

PCT Pub. Date: Apr. 11, 2002

(65) Prior Publication Data

US 2004/0050953 A1 Mar. 18, 2004

(30) Foreign Application Priority Data

Oct. 5, 2000 (JP) ..... 2000-305686
Oct. 5, 2000 (JP) ..... 2000-305688

(51) Int. Cl.[7] ..... B05B 1/08; B05B 3/04
(52) U.S. Cl. ..... 239/102.1; 239/102.2
(58) Field of Search ..... 239/102.1, 102.2, 239/65, 74, 302, 377; 310/317, 321–325; 128/200.14, 200.16

(56) References Cited

U.S. PATENT DOCUMENTS 5,255,016 A * 10/1993 Usui et al. ..... 347/71
5,518,179 A * 5/1996 Humberstone et al. .. 239/102.2
5,697,248 A * 12/1997 Brown ..... 73/290 V
6,273,342 B1 * 8/2001 Terada et al. ..... 239/102.2

FOREIGN PATENT DOCUMENTS

| | | |
|---|---|---|
| EP | 0 635 312 A1 | 1/1995 |
| EP | 0 950 524 A2 | 10/1999 |
| JP | 50-120012 | 10/1975 |
| JP | 63-16076 | 1/1988 |
| JP | 01143663 | 6/1989 |
| JP | 07080369 | 3/1995 |
| JP | 2546439 | 8/1996 |
| JP | 09010642 | 1/1997 |
| JP | 11300976 | 11/1999 |

* cited by examiner

*Primary Examiner*—Davis Hwu
(74) *Attorney, Agent, or Firm*—Morrison & Foerster LLP

(57) ABSTRACT

A bottle unit (30) of a liquid atomizing apparatus is provided with: a bottle section (31) reserving a chemical liquid (L); a horn oscillating member (40) to whose a distal end the liquid (L) in the bottle section (31) is fed; and a mesh member (1) having a number of fine pores (2), and mounted to an end surface of the distal end (41) of the horn oscillating member (40) in contact therewith. The bottle section (31) is constituted of a large capacity section (B) and a small capacity section (b) in communication with the large capacity section (B) through an opening (32), and opposing to the distal end (41) of the horn oscillating member (40). The small capacity section (b) is formed such that the liquid (L') therein is in contact with a point in the proximity of the contact section between the distal end (41) of the horn oscillating member (40) and the mesh member (1). With such a construction adopted, there can be provided a liquid atomizing apparatus that is obtained at a low cost with not only increased reliability but enhanced durability, and whose operations such as maintenance can be performed with simplicity and convenience without a necessity for a special liquid feed means.

9 Claims, 11 Drawing Sheets

LIQUID SPRAY DEVICE

TECHNICAL FIELD

The present invention relates to a liquid atomizing apparatus, and more particularly to an ultrasonic mesh type liquid atomizing apparatus atomizing a liquid using a horn oscillating member and a mesh member.

BACKGROUND ART

A conventional ultrasonic type liquid atomizing apparatus has a liquid atomizing construction as an example, as shown in FIG. 17. A liquid atomizing construction shown herein includes: a liquid reservoir section (a bottle) 70 reserving a liquid (a chemical liquid) L; an ultrasonic pump (a horn oscillating member) 77; and a mesh member 80. Horn oscillating member 77 is constructed of: a pipe 74 having liquid-suction through holes (water suction holes) 73 extending along an axial direction, and communicating from a lower end 71 located in bottle 70 to an opening provided at the top end 72 located outside bottle 70; and two annular oscillating members 75 and 76 mounted to pipe 74. Mesh member 80 is mounted to pipe top end 72 in contact therewith using an elastic member (not shown) such as a coil spring.

In such a liquid atomizing construction, a high frequency voltage generated by an oscillator 78 is applied to annular oscillating members 75 and 76, thereby causing annular oscillating members 75 and 76 to be ultrasonically oscillated and to oscillate pipe 74 upward and downward. With such a working, chemical liquid L in bottle 70 is sucked up from lower end 71 of pipe 74 through water suction holes 73 to come out of the opening of top end 72. Chemical liquid L is atomized away in a state of a fog by means of the mesh member 80 mounted to top end 72 in contact therewith.

In a liquid atomizing apparatus having the above liquid atomizing construction, however, a necessity exists for providing fine water suction holes for sucking up the chemical liquid into the pipe with an accompanying problem of much expenses in time and labor, and therefore increase in cost, in manufacturing aspect.

On the other hand, a liquid atomizing construction different from the above construction has been contrived in which pressure means such as a piston pressurizing a chemical liquid in a bottle is provided instead of a pipe having the above water suction holes, whereby the chemical liquid reserved in the bottle is little by little fed to an atomizing section (a contact section between the top end of the horn oscillating member and the mesh member).

Even a liquid atomizing apparatus equipped with a liquid atomizing construction of this kind, however, requires means operating pressure means, a structure linking both means, electrical interconnection and others separately in addition to the pressure means pressurizing the bottle. Therefore, problems have also arisen in reliability and operability in addition to a fault of complexity in feed means leading to high cost.

In the mean time, in a case where any of the above liquid atomizing constructions is adopted, while the mesh member is pressed onto the end surface of the distal end of the horn oscillating member by a force with a proper magnitude, a chemical liquid gathered in the proximity of the mesh member is leaked out onto the front surface and the periphery of the mesh member, and the leaked chemical liquid contaminates the outer surface of the apparatus and is hardened thereon to thereby hinder oscillation of the mesh member, thus having resulted in problems such as poor atomizing performance. What's worse, a need arises for carefulness so as to limit a chance of excessive inclination of the apparatus to the lowest probability, which has made handling of the apparatus difficult.

Moreover, in a liquid atomizing apparatus atomizing a chemical liquid using a mesh member, the chemical liquid is gathered in fine pores of the mesh member and is jetted in a state of a fog from the fine pores under pressure; therefore, fine pores 81 and 82 of mesh members 80A and 80B, as shown in FIGS. 18 and 19, have a step profile and a tapered profile, respectively, ea so as to be formed narrower toward the discharge side of liquid droplets 83 and wider in the surface side (the lower side in the view from above in the figure) thereof in contact with horn oscillating member 77 in longitudinal section.

Mesh members 80A and 80B are important factors in determination of an atomizing performance of a liquid atomizing apparatus, but acting as a main cause for clogging and degradation in performance of the mesh. For the purpose of raising a density of fine pores 81 or 82 is useful in order to enhance an atomizing efficiency, but with a distance between fine pores 81 or 82 made shorter with the result that degradation in strength of a mesh member occurs and droplets 83 jetted to outside, as shown in FIG. 18, lose directivity thereof to aggregate into dew drops 84 of large diameters. As shown in FIG. 18, droplets jetted to outside are attached back onto the atomization surface (the front surface) of mesh member 80A to form a film 85 thereon and therefore, liquid drops of large diameters fly away to the air, kinetic energy of atomization is lowered or the like inconvenience arises as problems.

It is, therefore, a first object of the present invention to simplify a feed structure for a liquid from a liquid reservoir section to an atomizing section, and it is a second object of the present invention to provide a liquid atomizing apparatus realizing no leakage of a liquid regardless of a degree of inclination thereof.

It is a third object of the present invention to provide a liquid atomizing apparatus, on one hand, realizing fine pores at a high density without causing degradation in strength, while, on the other hand, having a mesh member preventing liquid droplets from aggregating into a liquid drop and being attached onto an atomization surface.

DISCLOSURE OF THE INVENTION

In order to achieve the first object, a liquid atomizing apparatus of the present invention includes: a liquid reservoir section reserving a liquid; an oscillation source to whose distal end the liquid in the liquid reservoir section is fed; and a mesh member having many fine pores, and mounted to an end surface of the distal end of the oscillation source in contact therewith, the liquid in the liquid reservoir section being atomized by an oscillation action of combination of the oscillation source and the mesh member, wherein the liquid reservoir section is formed such that when the apparatus is inclined to the oscillation source side, the liquid therein reaches as far as a point in the proximity of a contact section between the distal end of the oscillation source and the mesh member, while when the apparatus is held in a horizontal state, the liquid does not reach as far as a point in the proximity of the contact section.

In an ordinary atomization state where the atomizing apparatus is inclined to the oscillation source side, since, in this apparatus, the liquid in the liquid reservoir section is fed directly to a point in the proximity of the contact section (hereinafter also referred to as an atomizing section) between the distal end of the oscillation source and the mesh member, no necessity arises for a special liquid feed means and the apparatus can be obtained at a low cost with not only increased reliability but enhanced durability. Of course, the liquid fed to a point in the proximity of the atomizing section reaches the mesh member by an oscillation action of combination of the oscillation source and the mesh member and is atomized there.

To be concrete, the liquid reservoir section is constituted of a large capacity section and a small capacity section in communication with the large capacity section, and opposing to the distal end of the oscillation source. The small capacity section is formed such that the liquid therein is in contact with a point in the proximity of the atomizing section. In this case, when the apparatus is in an ordinary atomization state where the apparatus is inclined to the oscillation source side, the liquid in the reservoir section first flows into the small capacity section from the large capacity section, and the liquid in the small capacity section is fed little by little to a point in the proximity of the atomizing section, and further reaches the mesh member and is atomized there by an oscillation action of combination of the oscillation source and the mesh member.

The liquid reservoir section is formed such that, when the apparatus is held in a horizontal state (a case other than an ordinary atomization), if the liquid in the large capacity section is at a prescribed quantity or less, the liquid in the large capacity section and the liquid in the small capacity section are isolated from each other. With such a construction, even in a case where turning-off of a power supply switch is forgotten, the liquid remaining in the proximity of the atomization section is rendered to a very small quantity only, so none of the liquid is wasted.

Both support members holding the mesh member therebetween are mounted on a mesh cap with packing and the mesh cap is further mounted to an opening section with another packing therebetween, resulting in no leakage of the liquid in the liquid reservoir section to outside through the opening section and improved easiness in handling. Especially, while liquid leakage is easy to occur in a case of a construction as described above in which a chemical liquid is fed to an atomizing section from a liquid reservoir section by inclining a liquid atomizing apparatus during its use, such a liquid leakage is effectively prevented from occurring by adopting a liquid-tight structure as is in the above construction.

In order to achieve the second object, a liquid atomizing apparatus of the present invention including: a liquid reservoir section reserving a liquid; an oscillation source to whose distal end the liquid in the liquid reservoir section is fed; and a mesh member having many fine pores, and mounted to an end surface of the distal end of oscillation source in contact therewith, the liquid in the liquid reservoir being atomized by an oscillation action of combination of the oscillation source and the mesh member, further including: an opening section through which an atomized chemical liquid is jetted; and a mesh cap mounted to the opening section, characterized in that the mesh member is held by one support member and the other support member therebetween and fixed to an end surface of the distal end of the oscillation source in contact therewith, both support members are mounted to the mesh cap with packing in one body and the mesh cap is mounted to the opening section with another packing therebetween.

In the atomizing apparatus, since both support members holding the mesh member therebetween are mounted to the mesh cap with packing and the mesh cap is further mounted to the opening section with another packing therebetween, none of the liquid in the reservoir section is leaked to outside, thereby improving easiness in handling.

Note that both packing may be formed in one body therebetween or alternatively, each may be formed in one body with a corresponding partner: the support member, the mesh cap or the liquid reservoir section. In any case, the number of parts decreases, leading to easiness in assembly.

In order to achieve the third object, a liquid atomizing apparatus of the present invention including: a liquid reservoir section reserving a liquid; an oscillation source to whose distal end the liquid in the liquid reservoir section is fed; and a mesh member having many fine pores, and mounted to an end surface of the distal end of the oscillation source in contact therewith, the liquid in the liquid reservoir section being atomized by an oscillation action of combination of the oscillation source and the mesh member, is characterized in that each of the fine pores of the mesh member includes: a liquid reserving portion formed in the side adjacent to the end surface of the distal end of the oscillation source; a hole through which the liquid in the liquid reserving portion is discharged as fine droplets; and a guide wall guiding the fine droplets discharged from the hole in the discharge direction.

In the atomizing apparatus, each of the fine pores of the mesh member includes: the liquid reserving portion, the hole, and the guide wall. In atomization, the liquid from the liquid reservoir section flows into a gap between the oscillation source and the mesh member, and further enters the liquid reserving portions of the mesh member, and the liquid in the liquid reserving portions is discharged through the holes as fine droplets by the oscillation action of combination of the oscillation source and the mesh member. The discharged fine droplets are ushered in the discharge direction by the guide wall and is jetted. Here, since the fine droplets are ushered in the discharge direction by the guide wall with good directivity, droplets discharged through adjacent holes are hard to aggregate therebetween and to attach onto the atomization surface. Moreover, since recoupling of droplets therebetween is suppressed, a density of fine pores can be increased.

Note that if a liquid reserving portion in a fine pore of the mesh member is designed to be circular in a cross section and not only is a depth of the liquid reserving portion thereof set to be equal to or more than an amplitude of the oscillation source, but a diameter of an inlet side thereof is also set to 10 times or less as large as that of a circular hole, stable atomization can be realized with more of efficiency. For example, in a case where an amplitude of the oscillation source is 10 $\mu$m, a depth of the liquid reserving portion circular in a cross section is set 10 $\mu$m or more, while if a diameter of the circular hole is 3 $\mu$m, a diameter of the inlet side of the liquid reserving portion is set to 30 $\mu$m or less.

Furthermore, if the mesh member is formed using a NiPd alloy by electroforming, a density of the fine pores can be further raised while keeping a sufficient strength with improvement on anticorrosiveness.

BEST MODE FOR CARRYING OUT THE INVENTION

Description will be given of an embodiment based on the present invention below.

Figure 1:
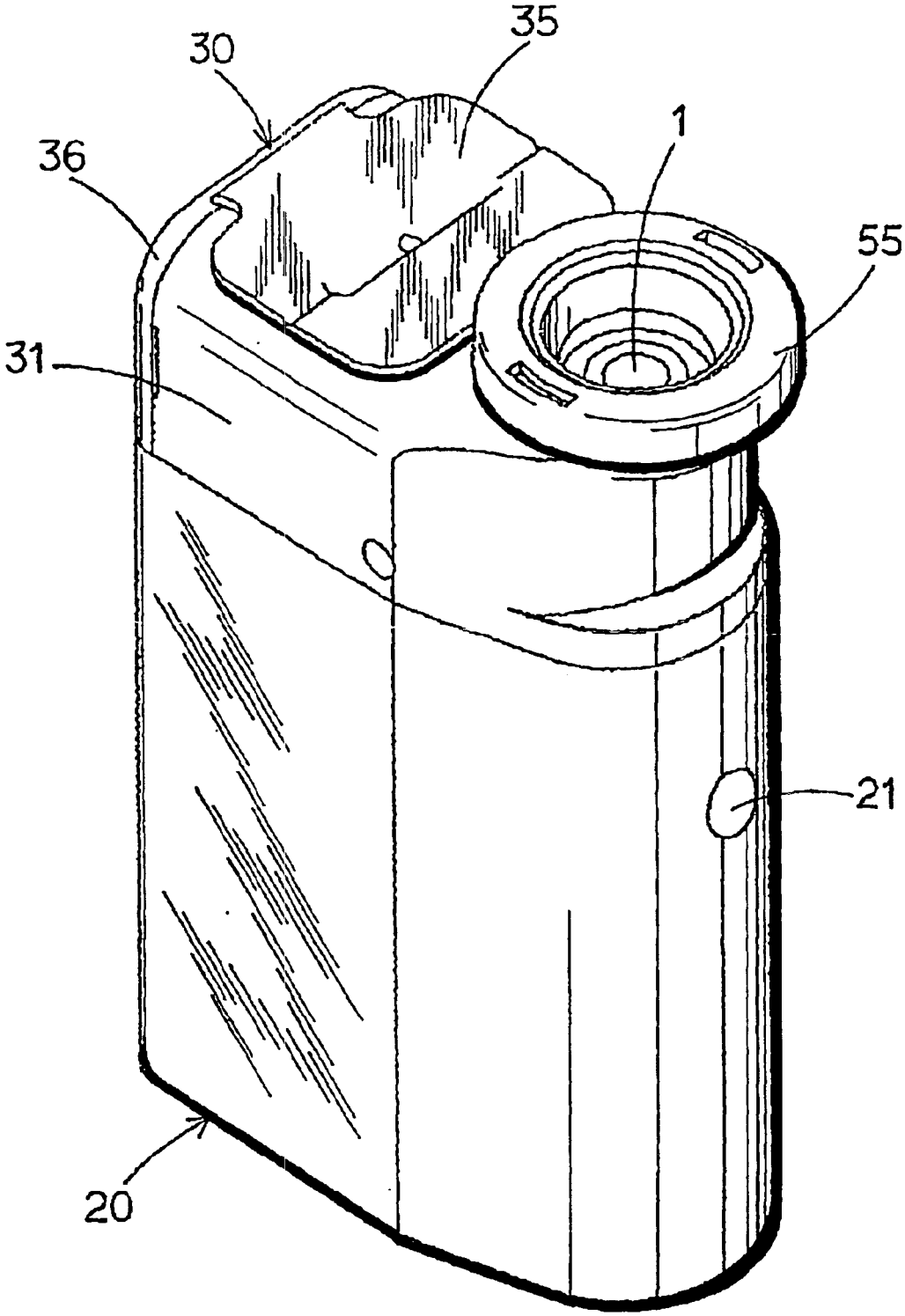
FIG. 1 is a perspective view of an appearance of a liquid atomizing apparatus according to an embodiment.

First of all, the description gets started with a configuration in appearance of a liquid atomizing apparatus relating to the embodiment based on the present invention with reference to FIG. 1. The liquid atomizing apparatus includes: not only a power supply switch 21 but also a body section 20 having a built-in battery and electrical circuitry therein and a bottle unit 30 attached to the body section 20 in a demountable manner.

Figure 2:
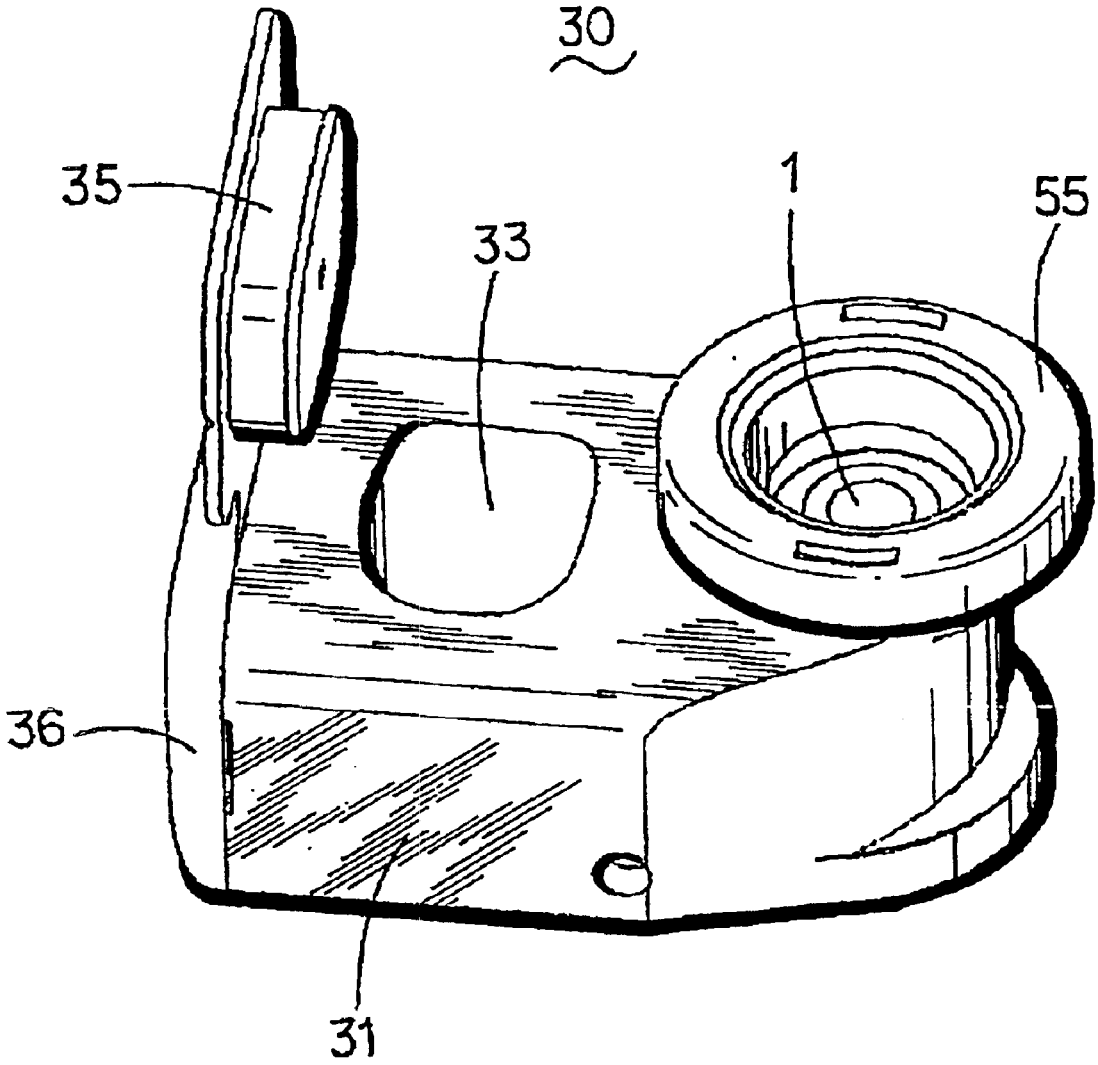
FIG. 2 is a perspective view of a bottle unit in the liquid atomizing apparatus according to an embodiment.
Figure 3:
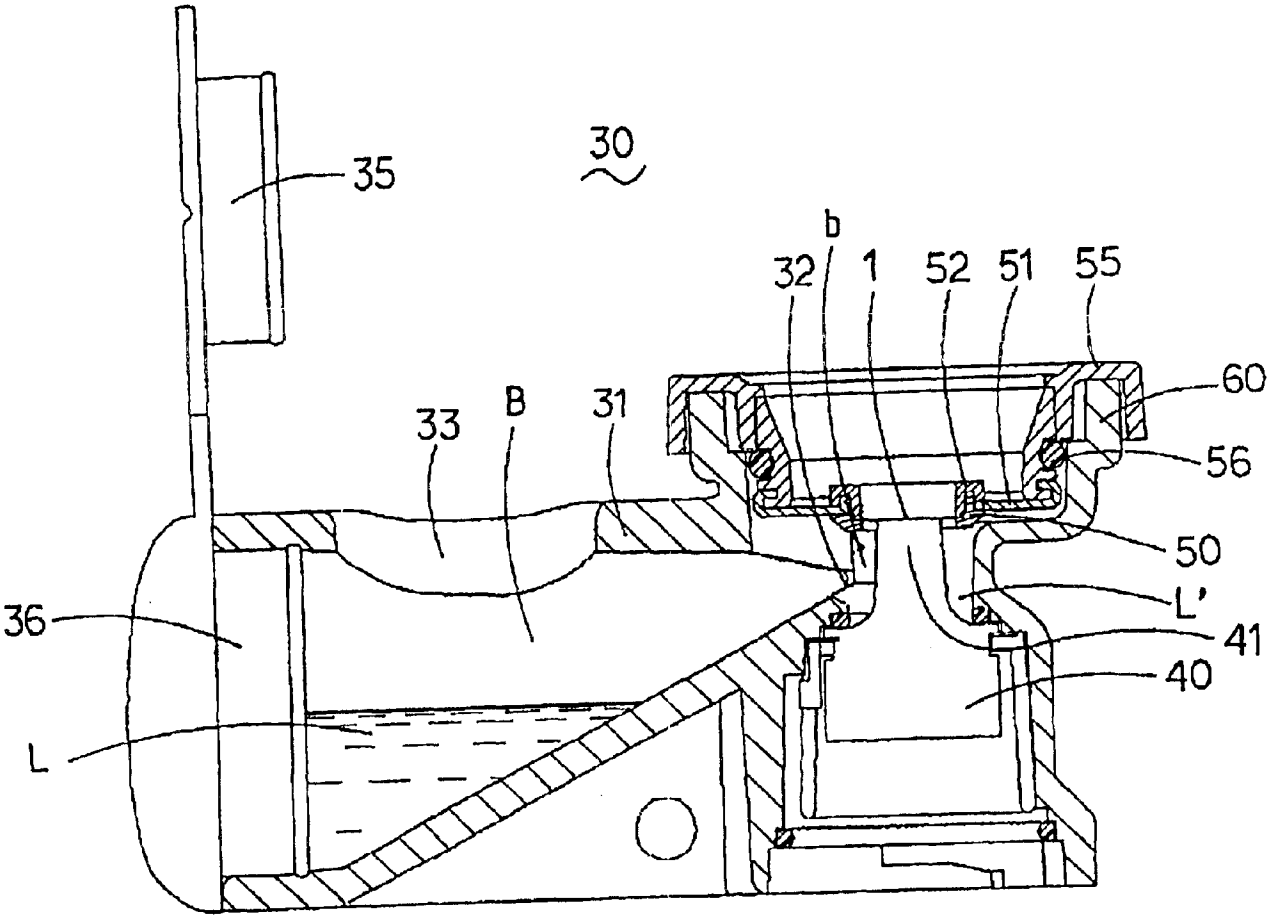
FIG. 3 is an enlarged sectional view of the bottle unit in the liquid atomizing apparatus according to an embodiment.
Figure 4:
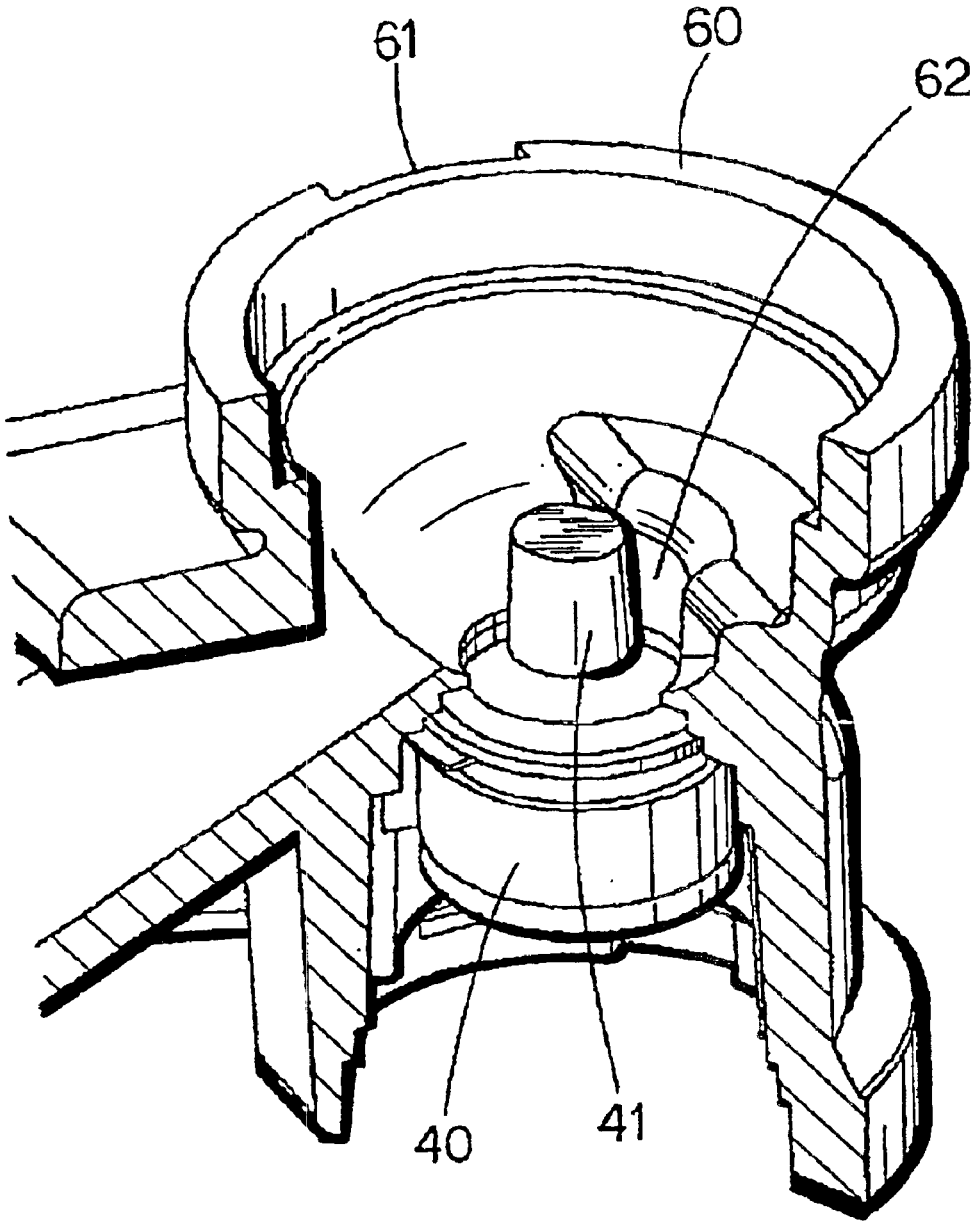
FIG. 4 is a partially cut-away perspective view of a main part of the bottle unit in the liquid atomizing apparatus according to an embodiment.
Figure 5:
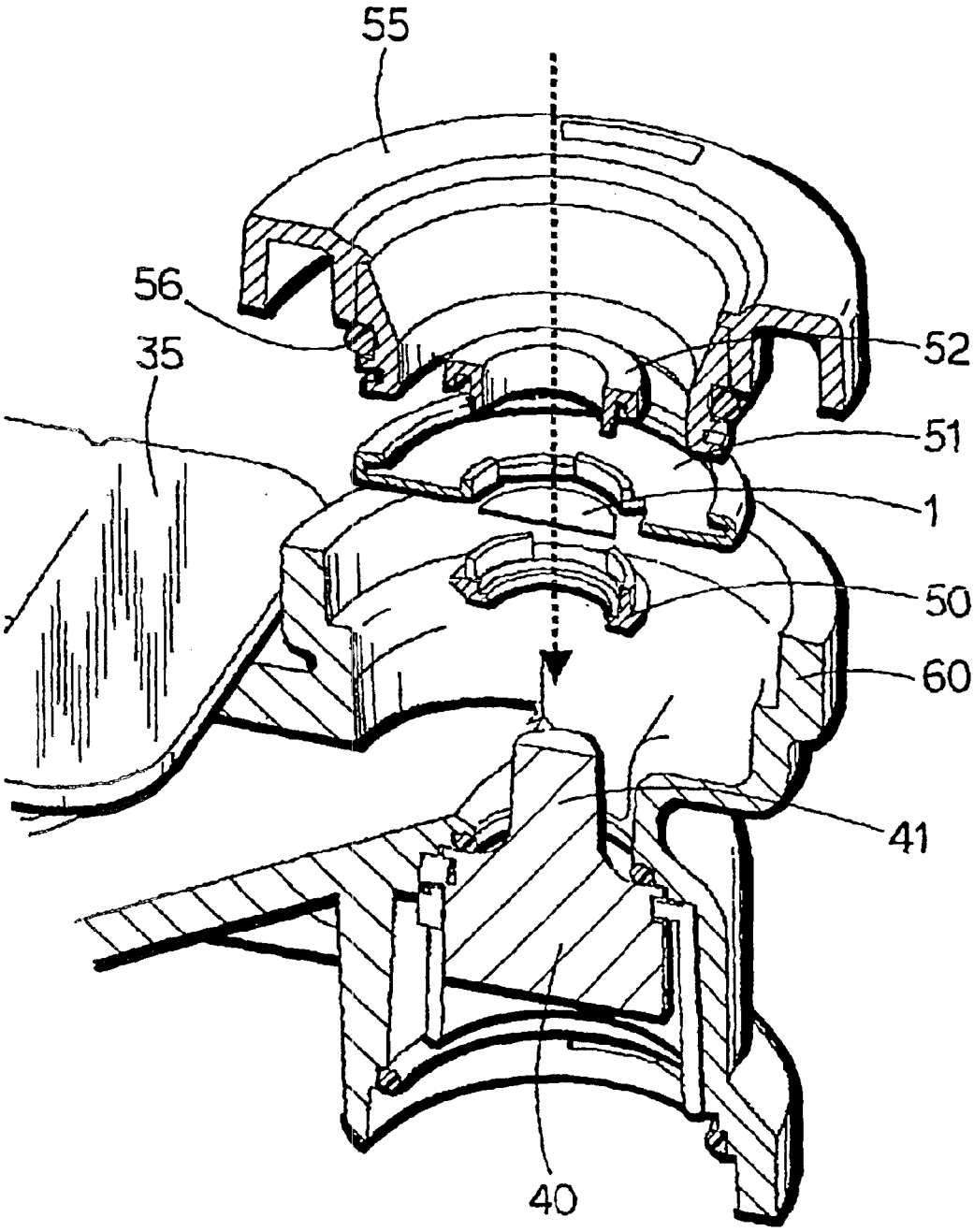
FIG. 5 is a perspective partially cut-away view of a main part of the bottle unit arranged in an expanded configuration in the liquid atomizing apparatus relating to an embodiment.
Figure 6:
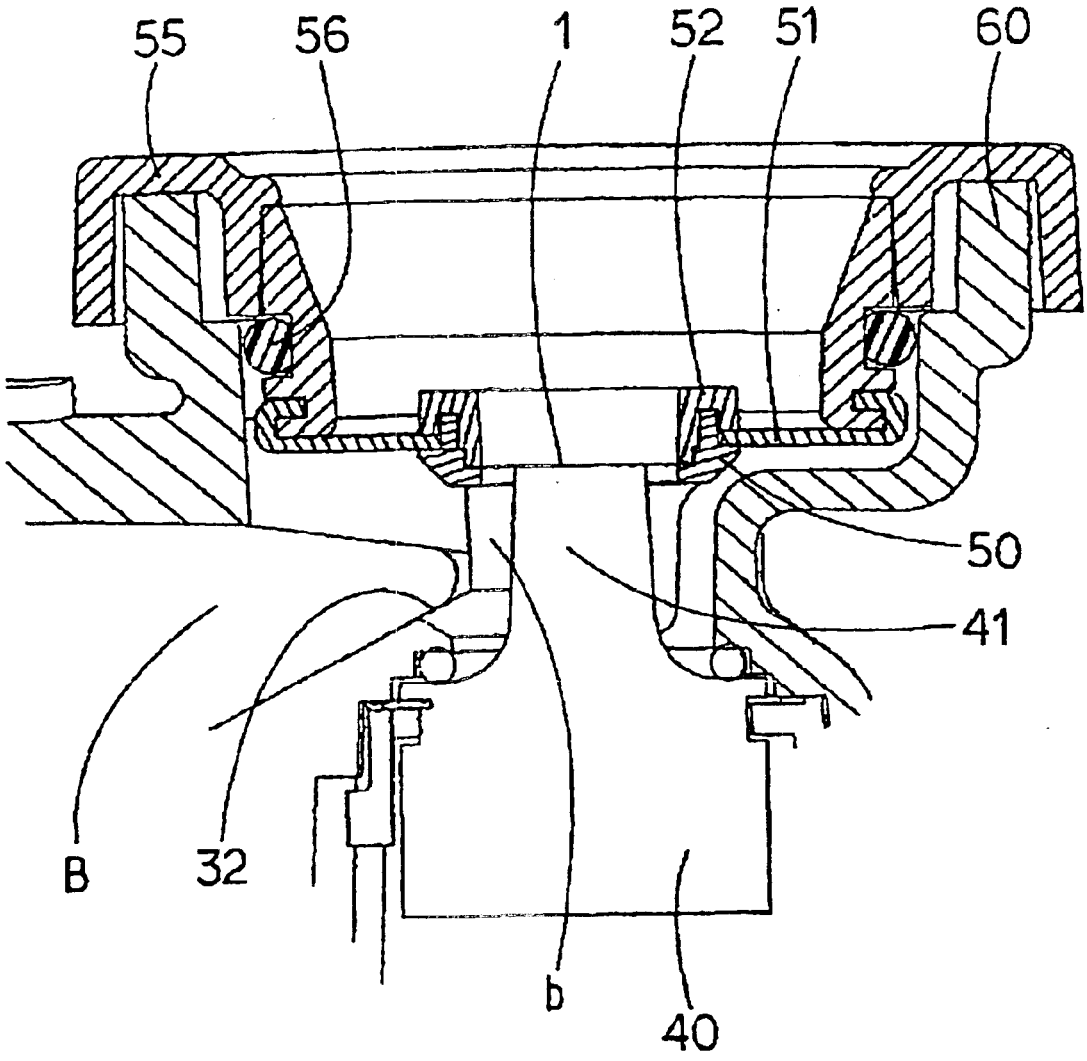
FIG. 6 is an enlarged longitudinal sectional view of a main part of the bottle unit in the liquid atomizing apparatus according to an embodiment.

Bottle unit 30 has a construction as shown in FIG. 2 (perspective view), FIG. 3 (longitudinal sectional view), FIG. 4 (partially cut-away perspective view of a main part), FIG. 5 partially cut-away perspective view of a main part in an expanded configuration) and FIG. 6 (enlarged longitudinal sectional view of a main part).

Bottle unit 30 is provided with: a liquid reservoir section (bottle section) 31 reserving a liquid (a chemical liquid) L; an oscillation source (a horn oscillating member) 40 to the distal end of which chemical liquid L in bottle section 31 is fed; and a mesh member 1 having many fine pores and mounted to the end surface of distal end 41 of horn oscillating member 40 in contact therewith.

Bottle section 31, as is apparent in FIG. 3, has an inclined bottom and the distal end opening 32 of its tapered body thereof, opposing to distal end 41 of horn oscillating member 40. Two caps 35 and 36 integrated in one body are mounted to bottle section 31 in a demountable manner. Cap 35 is for use in opening and closing liquid filling port 33 formed on bottle section 31, and cap 36 is for use in opening and closing an opening for use in cleaning (not attached with a symbol) formed on the other side of the tapered body from distal end opening 32. If caps 35 and 36 are both disengaged, cleaning inside bottle section 31 can be easily performed.

Bottle section 31 is formed such that liquid L reaches to a point in the proximity of a contact section (an atomizing section) between the end surface of distal end 41 of horn oscillating member 40 and mesh member 1 in an ordinary atomization state (in an inclined state shown in FIG. 7) where the apparatus is inclined to horn oscillating member 40 side, while when the apparatus is held in a horizontal state (a horizontal state shown in FIG. 3), liquid L does not reach a point in the proximity of the atomizing section. Here, bottle section 31 is constituted of a large capacity section B and a small capacity section b in communication with large capacity section B through opening 32, and opposing to distal end 41 of horn oscillating member 40. Small capacity section b is formed such that liquid L' reserved therein contacts a point in the proximity of the atomizing section. That is, small capacity section b is designed so as to have a capacity such that chemical liquid L' easily reach the atomizing section even with chemical liquid L' of a small quantity therein.

In bottle unit 30 of the embodiment, as shown in FIG. 4, small capacity section b is an annular space formed between an inner wall 62 of an opening section (a mesh cap mounting section) 60 through which atomized chemical liquid is jetted and distal end 41 of horn oscillating member 40. Therefore, chemical liquid L' flowing from large capacity section B of bottle section 31 to small capacity section b is eventually attached to the periphery of distal end 41. A spacing between inner wall 62 and distal end 41 of horn oscillating member 40 is set such that chemical liquid L' in small capacity section b in a state of a very small quantity of chemical liquid L' therein just prior to the time when chemical liquid L in large capacity section B is reduced to nothing, is fed as far as a point in the proximity of the atomizing section by a surface tension with mesh member 1 and distal end 41.

Bottle section 31 is formed such that in a case where in a position thereof (a horizontal state shown in FIG. 3) other than an ordinary atomization state (an inclined state of FIG. 7), when chemical liquid L in large capacity section B is reduced to a prescribed quantity or less, chemical liquid L in large capacity section B and chemical liquid L' in small capacity section b are isolated from each other. That is, in a case where chemical liquid L does not fill large capacity section B to the full, when the liquid surface is lower than opening 32, chemical liquid L' in small capacity section b is left behind around the periphery of distal end 41 of horn oscillating member 40 only at a very small quantity thereof, while the rest of chemical liquid L is reserved in large capacity section B since small capacity section b assumes a position higher than large capacity section B.

Note that in a state where caps 35 and 36 are mounted to bottle section 31 and a mesh cap 55 described later to opening section 60, the interior of bottle section 31 is sealed liquid-tight except for a hole for introduction of the outside air formed on cap 35.

On the other hand, referring to FIG. 5, a horn oscillating member 40 opposing opening 32 of bottle section 31 is mounted on the lower side of opening section 60 of bottle unit 30 and mesh cap 55 is mounted to opening section 60 at the top side of horn oscillating member 40 in a demountable manner. Mesh member 1 on distal end 41 of horn oscillating member 40 is held between one support member 50 and the other support member 52 and fixed to the end surface of distal end 41 in a contact state therewith. Both support members 50 and 52 in engagement are mounted to mesh cap 55 with annular sealing support packing 51.

The inner periphery of annular sealing support packing 51 is engaged with support members 50 and 52, and the outer periphery thereof is engaged with mesh cap 55, thereby sealing a gap between support members 50 and 52, and mesh cap 55 with sealing support packing 51. Moreover, a ring-like liquid-tight packing 56 is provided between mesh cap 55 and opening section 60 and a gap between mesh cap 55 and opening section 60 are sealed with liquid-tight packing 56. Hence, chemical liquids L and L' in bottle section 31 is kept without leaking from opening 60 by both packing 51 and 56 to outside. With such a structure adopted, neither of chemical liquids L and L' in bottle section 31 is leaked to outside even when the atomizing apparatus is inclined, thereby improving easiness in handling.

Note that referring to FIG. 4, in opening section 60 of bottle unit 30, there is formed an engaged section 61 engaged by an engaging nail (not shown) formed on mesh cap 55 such that opening section 60 and mesh cap 55 are engaged with each other to fix mesh cap 55. When mesh member 1 is necessary to be put in contact with the end surface of distal end 41 of horn oscillating member 40 by a proper magnitude of a force, a force for pressure varies in magnitude due to a fluctuation in size of parts and a dimensional fluctuation in mounting of parts; therefore, a necessity arises for absorbing such fluctuations. Here, with a construction in which support members 50 and 52 holding mesh member 1 therebetween are further supported by sealing support packing 51 being adopted, that is with a construction in which mesh member 1 is in contact with the end surface of distal end 41 of horn oscillating member 40 by way of sealing support packing 51 being adopted, the fluctuations can be absorbed by elasticity of sealing support packing 51 itself, thereby, enabling a positional relationship between mesh section i and the end surface of distal end 41 to be held in a stable manner.

Mesh cap 55 with which mesh member 1, support members 50 and 52, sealing support packing 51 and liquid-tight packing 56 are integrally mounted into one body is further mounted to opening section 60 in a freely demountable manner but handling in maintenance such as cleaning of mesh member 1 is easy and convenient by removing mesh cap 55 from opening section 60 since mesh member 1 is mounted to mesh cap 55.

Note that while in the embodiment, sealing support packing 51 and liquid-tight packing 56 are separates parts, both packing 51 and 56 may be formed either into one body therebetween or into one body with support members 50 and 52 or mesh cap 55 by monolithic molding. In this case, the number of parts decreases to facilitate assembly. Both packing each has no specific limitation on material and a shape thereof as far as an effect equal to that described above is ensured.

Figure 7:
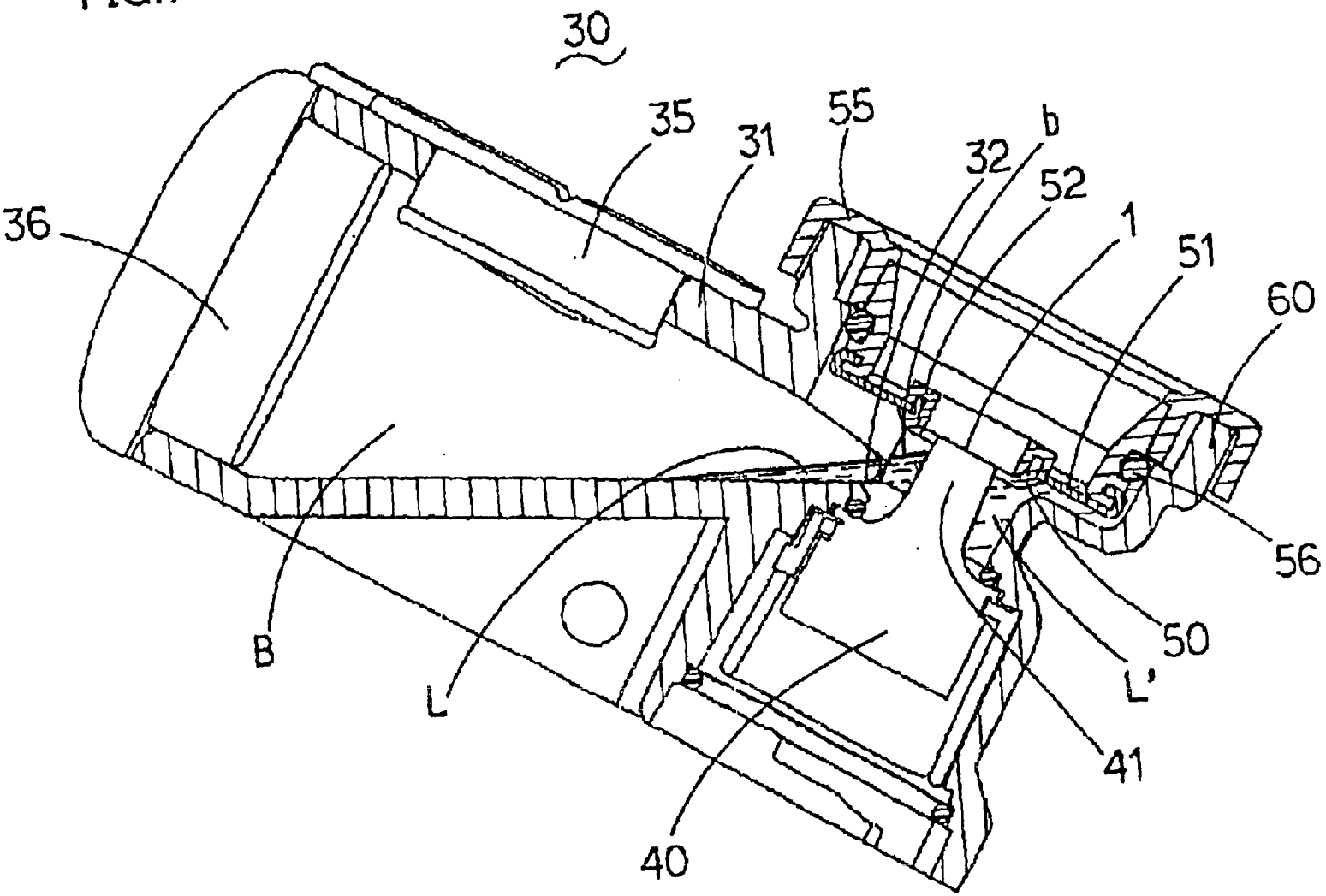
FIG. 7 is a longitudinal sectional view of the bottle unit in the liquid atomizing apparatus according to an embodiment.
Figure 8:
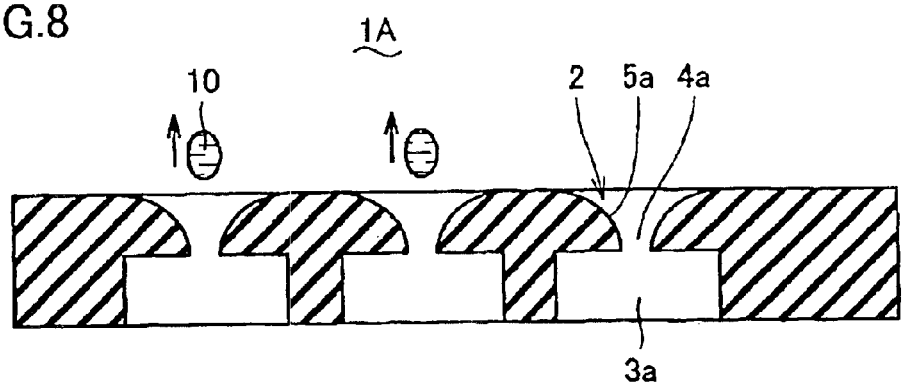
FIG. 8 is a partially enlarged longitudinal sectional view of a mesh member of a form used in the liquid atomizing apparatus according to an embodiment.

When a liquid atomizing apparatus obtained by mounting bottle unit 30 to body section 20 is placed on the top of a desk or the like, bottle unit 30 assumes a horizontal position as shown in FIG. 3 and chemical liquid L in bottle section 31 stays in the bottom portion of bottle section 31. When the apparatus is inclined to the horn oscillating member 40 side carrying it on by hand in atomization, bottle unit 30 is inclined as shown in FIG. 7 chemical liquid L in large capacity section B flows into small capacity section b through distal end opening 32. Chemical liquid L' in small capacity section b reaches a point in the proximity of the contact section between distal end 41 of horn oscillating member 40 and mesh member 1.

Here, when power switch 21 of body section 20 is pressed down, horn oscillating member 40 is ultrasonically oscillated and by ultrasonic oscillation of combination of mesh member 1 and distal end 41 of horn oscillating member 40, chemical liquid L' in small capacity section b is fed as far as mesh member 1, chemical liquid L' is discharged through fine pores of mesh member 1 as droplets and then the droplets are jetted from opening section 60. During the atomization, chemical liquid L' is little by little fed stably from small capacity section b to mesh member 1.

Even if chemical liquid L in large capacity section B of bottle section 31 is reduced to a very small quantity (see FIG. 7), chemical liquid L' in small capacity section b is raised to a point in the proximity of the atomizing section by a surface tension with distal end 41 of horn oscillating member 40 and inner wall 62 as described above and further fed to mesh member 1 by oscillation of horn oscillating member 40.

On the other hand, in a case other than an ordinary use of the atomizing apparatus, for example, when the atomizing apparatus ceases its operation temporarily or is placed on a desk, almost all the chemical liquid L' in small capacity section b comes to be reserved into large capacity section B leaving a trace of the order of a quantity to be attached inner wall 62 unless chemical liquid L fills large capacity section B of bottle section 31 to almost the full. Therefore, even in a case where turning-off of power supply switch 21 is forgotten, none of the chemical liquid is wasted. Moreover, with combination with an auto-power off function as safety measure to cope with no chemical liquid remaining, wasteful consumption of a battery can be prevented.

Moreover, in a case other than ordinary atomization (in a horizontal state as shown in FIG. 3), since no chemical liquid is fed to the contact section between distal end 41 of horn oscillating member 40 and mesh member 1, that is, since no chemical liquid is present on mesh member 1, neither bleeding nor leakage of chemical liquid occurs. Of course, as described above, the arises no leakage of chemical liquids L an L' of bottle section 31 to outside. For such reasons, easiness in handling of an atomizing apparatus is improved.

Then, referring to FIGS. 8 to 16, description will be given of a shape of each of fine pores formed in a mesh member relating to the embodiment. First of all, a mesh member 1A shown in FIG. 8 has many fine pores 2 and fine pores 2 each include: a liquid reserving portion 3*a* formed in the side adjacent to the end surface of distal end 41 of oscillation source 40; a hole 4*a* through which the liquid in liquid reserving portion 3*a* is discharged as fine droplets 10; and a guide wall 5*a* guiding fine droplets 10 discharged from hole 4*a* in the discharge direction. Here, liquid reserving portion 3*a* is cylindrical, hole 4*a* is circular and guide wall 5*a* is in the shape of an inverse circular cone frustum.

Figure 9:
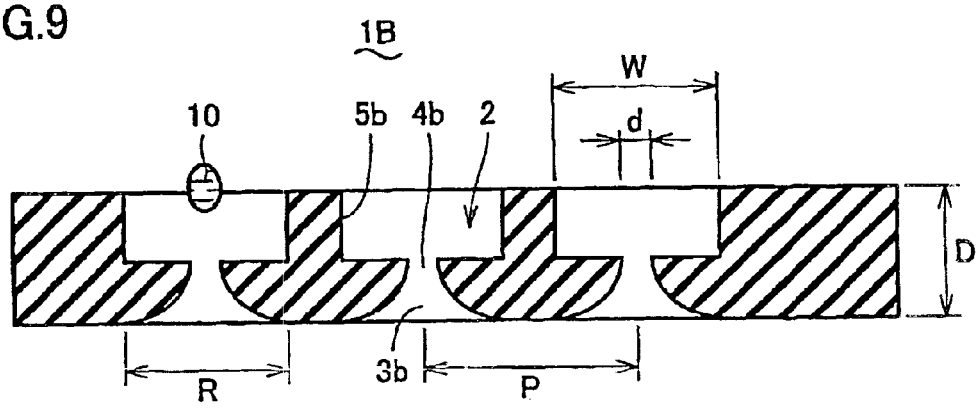
FIG. 9 is a partially enlarged longitudinal sectional view of a mesh member of another form used in the liquid atomizing apparatus according to an embodiment.

On the other hand, a mesh member 1B shown in FIG. 9 has a shape of longitudinal section obtained by inverting the longitudinal section of mesh member 1A upside down and each of fine pores 2 thereof includes: a liquid reserving portion 3*b* in the shape of a circular cone frustum; a hole 4*b* in the shape of a circle and a guide wall 5*b* in the shape of a cylinder. Dimensions of mesh member 1B are exemplified as follows: a thickness D of mesh member 1B is 20 μm, a diameter R of the entrance at the innermost side is 20 to 25 μm, a diameter d of hole 4*b* is 3 μm, a diameter W of the exit of a space forming guide wall at the outermost side is 20 to 25 μm, and a pitch P of liquid reserving portions (that is, fine pores 2) 3*b* are 40 μm. Of course, the dimensions are an example and they have only to be adjusted in a proper manner according to a size of mesh member 1B in the entirety, which applies to mesh member 1A, and mesh members 1C to 1I described later in a similar manner.

In any of mesh members 1A and 1B, liquid (chemical liquid) fed from a liquid reservoir section enters liquid reserving portion 3*a* or 3*b*, discharged as fine droplets 10 from hole 4*a* or 4*b* by an oscillation action of combination of the oscillation source and mesh member 1A or 1B, and discharged fine droplets 10 are guided in the discharge direction (in the direction of an arrow mark) with good directivity by guide wall 5*a* or 5*b*. Therefore, fine droplets 10 discharged from adjacent holes 4*a* or 4*b* are hard to be recoupled and hard to be attached onto the atomization surface (the front surface) of mesh member, thus solving problems of producing drops having large diameters and reducing kinetic energy of atomization. Moreover, because of difficulty in recoupling of fine droplets 10, a density of fine pores 2 can be raised. With such effects described above, stable atomization can be realized with more of efficiency.

Figure 10:
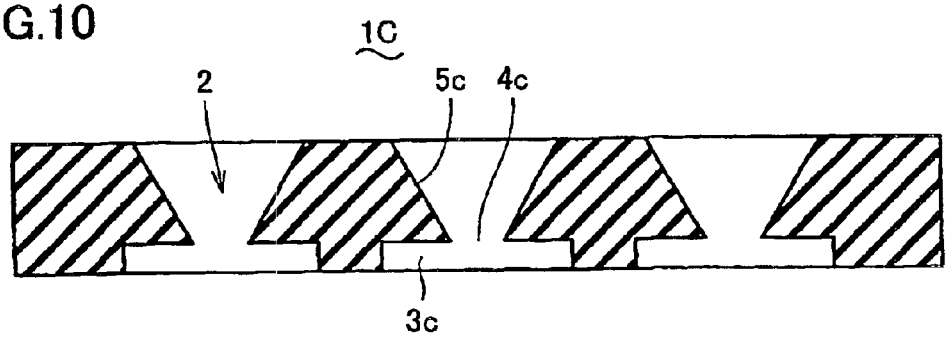
FIG. 10 is a partially enlarged longitudinal sectional view of a mesh member of still another form used in the liquid atomizing apparatus according to an embodiment.
Figure 11:
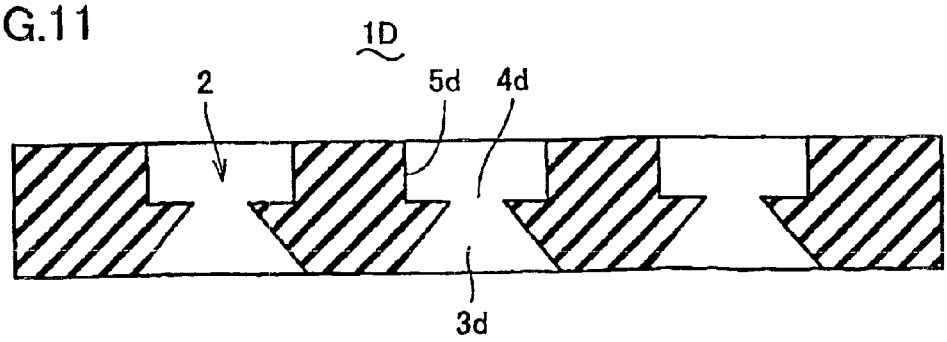
FIG. 11 is a partially enlarged longitudinal sectional view of a mesh member of yet another form used in the liquid atomizing apparatus according to an embodiment.

Fine pores 2 of mesh member 1C shown in FIG. 10 each include: a liquid reserving portion 3*c* in the shape of a cylinder; a hole 4*c* in the shape of a circle; and a guide wall 5*c* in the shape of an inverse circular cone frustum. A mesh member 1D shown in FIG. 11 has a shape of longitudinal section of almost an inversion of the longitudinal section of mesh member 1C upside down and each of fine pores 2 thereof includes: a liquid reserving portion 3*d* in the shape of a circular cone frustum; a hole 4*d* in the shape of a circle and a guide wall 5*d* in the shape of a cylinder.

Figure 12:
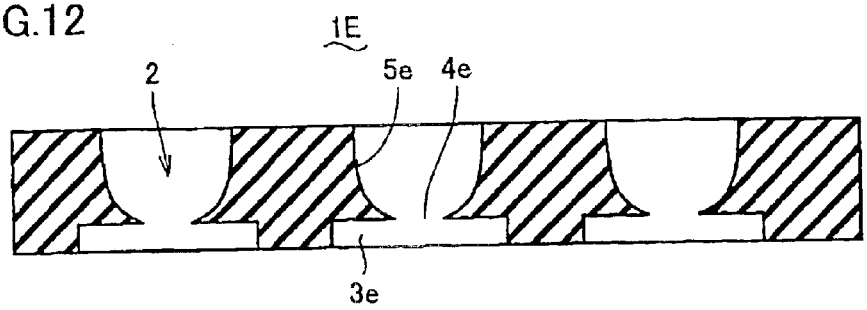
FIG. 12 is a partially enlarged longitudinal sectional view of a mesh member of a further form used in the liquid atomizing apparatus according to an embodiment.
Figure 13:
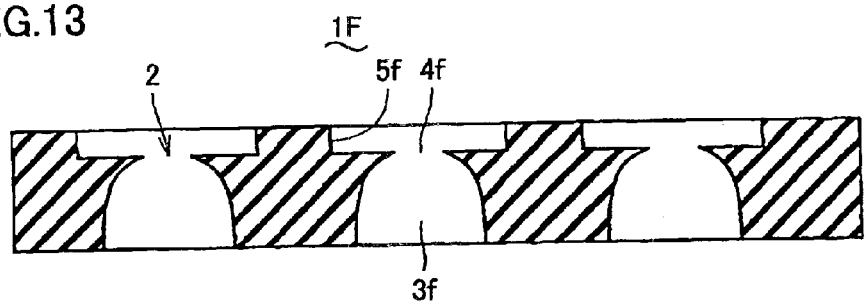
FIG. 13 is a partially enlarged longitudinal sectional view of a mesh member of a still further form used in the liquid atomizing apparatus according to an embodiment.

Fine pores 2 of a mesh member 1E of FIG. 12 each include: a liquid reserving portion 3*e* in the shape of a cylinder; a hole 4*e* in the shape of a circle and a guide wall 5*e* in the shape of a letter U in longitudinal section and contrary to this, fine pores 2 of a mesh member 1F of FIG. 13 each include: a liquid reserving portion 3*f* in the shape of an inverse letter U in longitudinal section; a hole 4*f* in the shape of a circle and a guide wall 5*f* in the shape of a cylinder.

Figure 14:
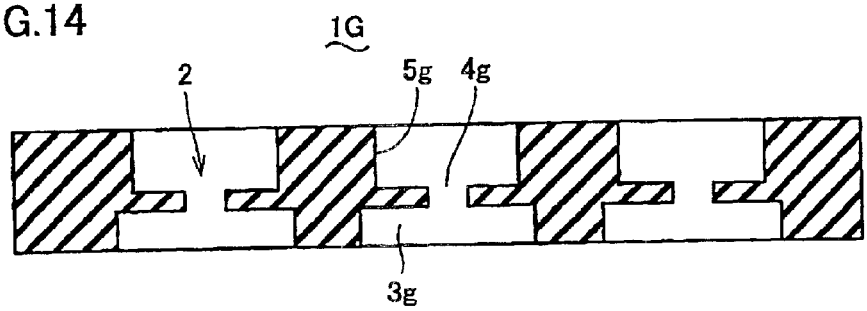
FIG. 14 is a partially enlarged longitudinal sectional view of a mesh member of a yet further form used in the liquid atomizing apparatus according to an embodiment.
Figure 15:
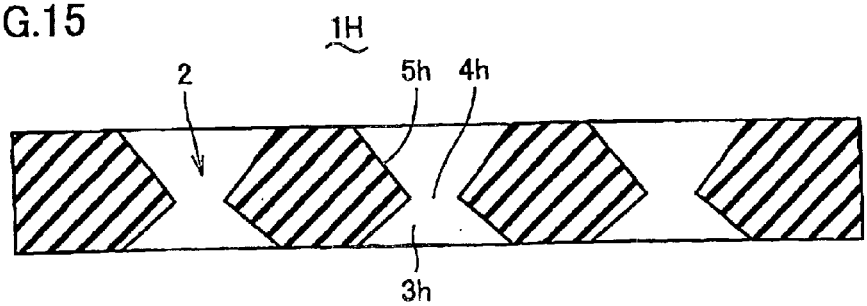
FIG. 15 is a partially enlarged longitudinal sectional view of a mesh member of another form used in the liquid atomizing apparatus according to an embodiment.

Fine pores 2 of a mesh member 1G of FIG. 14 each include: a liquid reserving portion 3*g* in the shape of a cylinder; a hole 4*g* in the shape of a circle and a guide wall 5*g* in the shape of a cylinder, and fine pores 2 of a mesh member 1H of FIG. 15 each include: a liquid reserving portion 3*h* in the shape of a circular cone frustum; a hole 4*h* in the shape of a circle and a guide wall 5*h* in the shape of an inverse circular cone frustum.

Figure 16:
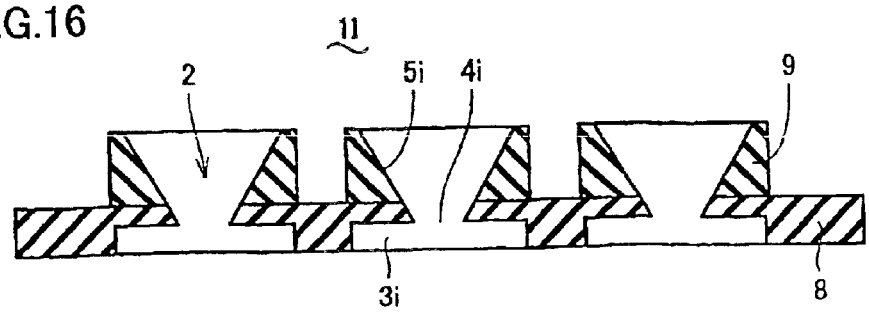
FIG. 16 is a partially enlarged longitudinal sectional view of a mesh member of still another form used in the liquid atomizing apparatus according to an embodiment.
Figure 17:
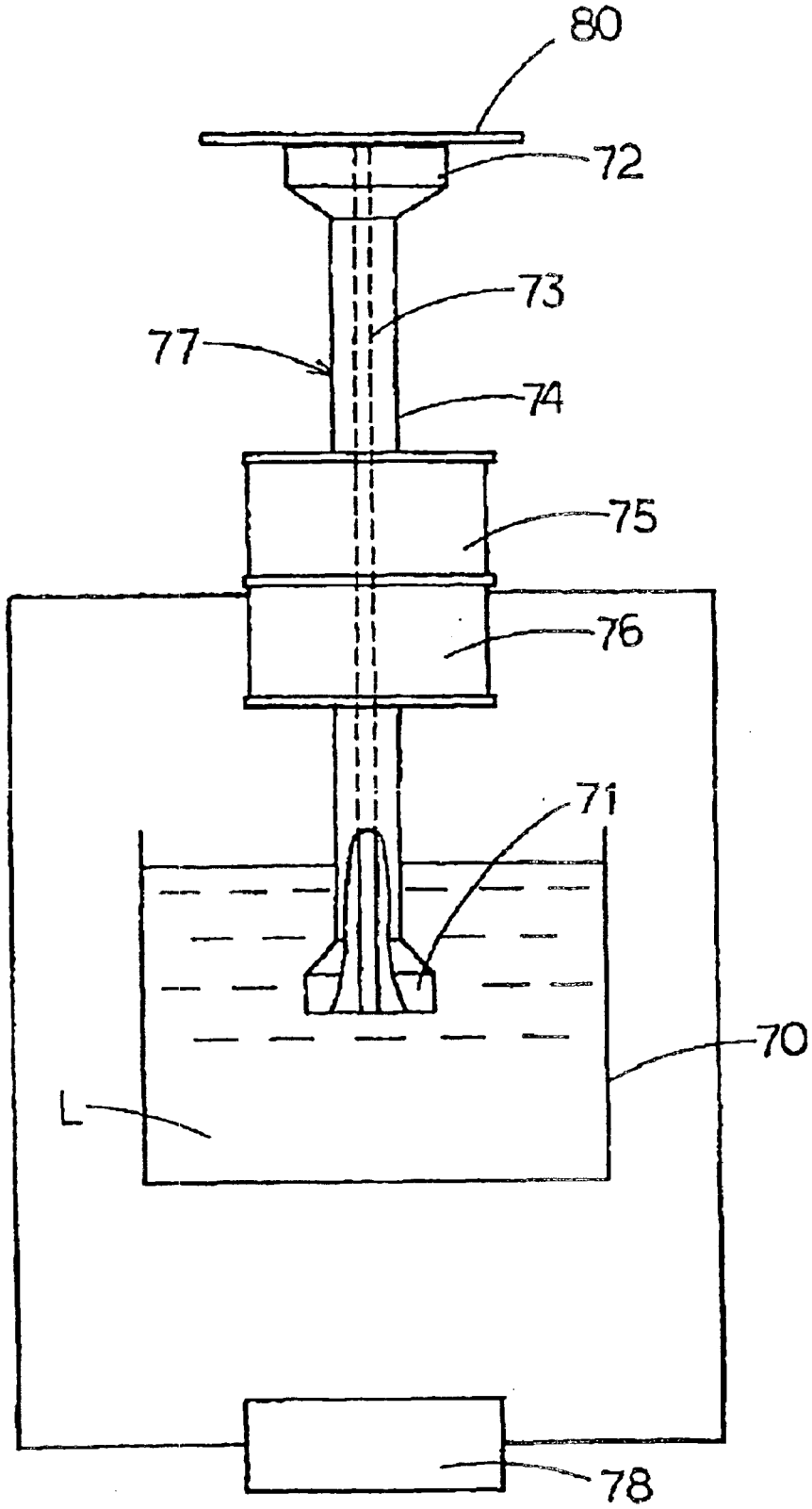
FIG. 17 is a schematic view of a construction of a main part of a liquid atomizing apparatus according to a conventional example.
Figure 18:
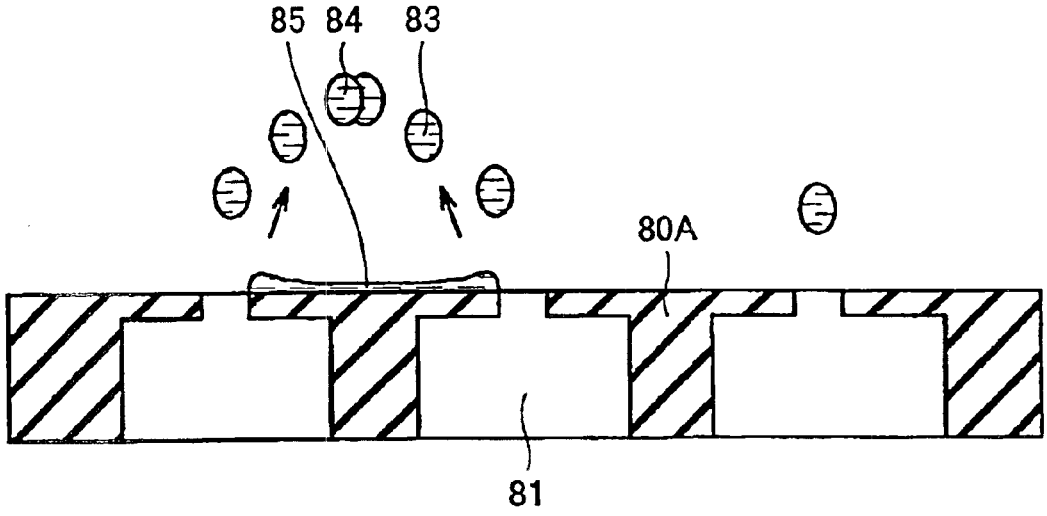
FIG. 18 is a partially enlarged longitudinal sectional view of a mesh member of a form according to the conventional example.
Figure 19:
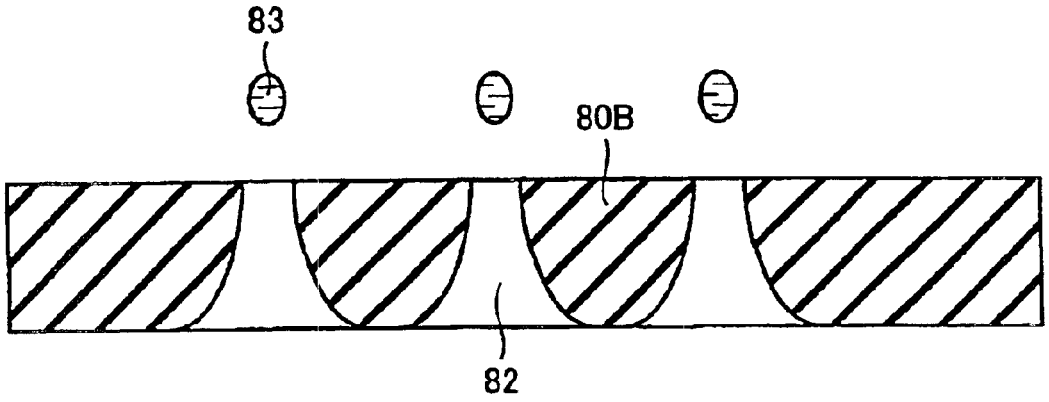
FIG. 19 is a partially enlarged longitudinal sectional view of a mesh member of another form according to the conventional example.

A mesh member 1I of FIG. 16 has a body section 8 and protruding sections 9 each in the shape of a cylinder, and fine pores 2 each include: a liquid reserving portion 3*i* formed in body section 8 in the shape of a cylinder; a hole 4*i* formed in body section 8; and a guide wall 5*i* in the shape of an inverse circular cone frustum, formed in the bulk from body section 8 to the top of protruding section 9.

Of course, any of mesh members 1C to 1I shown in FIGS. 8 to 16 exerts an effect similar to that described above as well. Shapes of fine pores in respective mesh members 1A to 1I shown in FIGS. 8 to 16 are examples, wherein, with freedom of selection, the shapes can be modified with other shapes incorporated thereinto or can be partly combined with each other as far as a similar effect is ensured in modification or each combination. Furthermore, if mesh members 1A to 1I are formed using an NiPd alloy by electroforming, a density of fine pores 2 can be further raised while keeping a sufficient strength, thereby improving anti-corrosiveness.

According to the present invention, as described above, since in an ordinary atomization state where the apparatus is inclined to the oscillation source, a liquid in the reservoir section is fed directly to a point in the proximity of the contact section between the distal end of the oscillation source and a mesh member, no necessity arises for a special feed means, and the apparatus can be fabricated at low cost with high reliability and good durability and operations associated with maintenance or the like are simple and convenient.

Moreover, according to the present invention, since both support members holding a mesh member therebetween can be mounted with packing to a mesh cap and further, the mesh cap is mounted to an opening section with another packing therebetween, there arises no leakage of a liquid in a liquid reservoir section through the opening section to outside, thereby improving easiness in handling.

Furthermore, according to the present invention, since each of fine pores of a mesh member includes: a liquid reserving portion, a hole and a guide wall, and fine droplets discharged from the hole are guided in the discharge direction by the guide wall with good directivity, fine droplets discharged from adjacent holes are hard to be recoupled and hard to be attached onto the atomization surface. In addition, since the recoupling of fine droplets are suppressed, a density of fine pores can be raised, thereby enabling stable atomization with more of efficiency.

Note that it should be understood that the embodiment disclosed this time is presented not by way of limitation but by way of illustration in all aspects. The technical scope of the present invention is not defined by the above description but by the terms of appended claims, and intended to include all modifications in a scope equivalent to the claims.

Industrial Applicability

The present invention relates to ultrasonic mesh type liquid atomizing apparatus atomizing a chemical liquid in a liquid reservoir section and provides a version having a simplified feed structure for a liquid to the atomization section from the liquid reservoir section. Moreover, the present invention provides a liquid atomizing apparatus realizing no leakage of liquid regardless of a degree of inclination of the apparatus. Moreover, the present invention provides a liquid atomizing apparatus that, on one hand, realizes fine pores at a high density without causing degradation in strength, while on the other hand, having a mesh member preventing liquid droplets from aggregating into a liquid drop and being attached onto an atomization surface.

What is claimed is:

1. A liquid atomizing apparatus comprising: a liquid reservoir section (31) reserving a liquid (L); an oscillation source (40) to whose distal end this liquid (L) in this liquid reservoir section (31) is fed; and a mesh member (1) having a number of fine pores (2), and mounted to an end surface of a distal end (41) of this oscillation source (40) in contact therewith, and atomizing the liquid (L) in the liquid reservoir section (31) by an oscillation action of combination of the oscillation source (40) and the mesh member (1), wherein said liquid reservoir section (31) is formed such that when the apparatus is inclined to an oscillation source (40) side, the liquid (L) therein reaches as far as a point in the proximity of a contact section between the distal end (41) of the oscillation source (40) and the mesh member (1), while when the apparatus is held in a horizontal state, the liquid (L) does not reach as far as a point in the proximity of said contact section.

2. The liquid atomizing apparatus according to claim 1, wherein said liquid reservoir section (31) is constituted of a large capacity section (B) and a small capacity section (b) in communication with this large capacity section (B), and opposing to the distal end (41) of said oscillation source (40), and the small capacity section (b) is formed such that the liquid (L) therein is in contact with a point in the proximity of the contact section between the distal end (41) of the oscillation source (40) and the mesh member (1).

3. The liquid atomizing apparatus according to claim 2, wherein said liquid reservoir section (31) is formed such that, when the apparatus is held in a horizontal state, if the liquid (L) in the large capacity section (B) is at a prescribed quantity or less, the liquid (L) in the large capacity section (B) and a liquid (L') in the small capacity section (b) are isolated from each other.

4. The liquid atomizing apparatus according to claim 1, further comprising: an opening section (60) through which an atomized chemical liquid is jetted; and a mesh cap (55) mounted to this opening section (60), wherein said mesh member (1) is held by one support member (50) and the other support member (52) therebetween and fixed to an end surface of the distal end (41) of the oscillation source (40) in contact therewith, both support members (50, 52) are mounted to said mesh cap (55) with packing (51) in one body and this mesh cap (55) is mounted to the opening section (60) with another packing (56) therebetween.

5. A liquid atomizing apparatus comprising: a liquid reservoir section (31) reserving a liquid (L); an oscillation source (40) to whose a distal end (41) the liquid (L) in this liquid reservoir section (31) is fed; and a mesh member (1) having a number of fine pores (2), and mounted to an end surface of the distal end (41) of this oscillation source (40) in contact therewith, and atomizing the liquid (L) in the liquid reservoir section (31) by oscillation action of combination of the oscillation source (40) and the mesh member (1), wherein the apparatus further comprises: an opening section (60) through which an atomized chemical liquid is jetted; and a mesh cap (55) mounted to this opening section (60), said mesh member (1) is held by one support member (50) and the other support member (52) therebetween and fixed to an end surface of the distal end (41) of the oscillation source (40) in contact therewith, both support members (50, 52) are mounted to said mesh cap (55) with packing (51) in one body, and this mesh cap (55) is mounted to the opening section with another packing (56) therebetween.

6. The liquid atomizing apparatus according to claim 5, wherein said both packing (51, 56) are formed in one body therebetween.

7. The liquid atomizing apparatus according to claim 5, wherein each said both packing (51, 56) is formed in one body with the support member (50, 52), the mesh cap (55) or the liquid reservoir section (31).

8. A liquid atomizing apparatus comprising: a liquid reservoir section (31) reserving a liquid (L); an oscillation source (40) to whose a distal end (41) the liquid (L) in this liquid reservoir section (31) is fed; and a mesh member (1) having a number of fine pores (2), and mounted to an end surface of the distal end (41) of this oscillation source (40) in contact therewith, and atomizing the liquid (L) in the liquid reservoir section (31) by an oscillation action of combination of the oscillation source (40) and the mesh member (1), wherein said member (1) is formed using an NiPD alloy by electroforming, and each of said fine pores (2) of said mesh member (1) includes: a liquid reserving portion (3*a*) formed in the side adjacent to the end surface of the distal end (41) of the oscillation source (40); a hole (4*a*) through which the liquid in this liquid reserving portion (3*a*) is discharged as fine droplets; and a guide wall (5*a*) guiding the fine droplets discharged from this hole (4*a*) in a discharge direction.

9. The liquid atomizing apparatus according to claim 8, wherein the liquid reserving portion (3*a*) in the fine pore (2) of said mesh member (1) is designed to be circular in a cross section and not only is a depth of the liquid reserving portion (3*a*) thereof set to be equal to or more than an amplitude of the oscillation source (40), but a diameter of an inlet side thereof is also set to 10 times or less as large as that of the circular hole (4*a*).

* * * * *